United States Patent [19]

Ivanov

[11] 4,276,847

[45] Jul. 7, 1981

[54] METHOD FOR ASSEMBLING HULLS OF VESSELS

[76] Inventor: Jury P. Ivanov, Grazhdansky prospekt, 92/2, kv. 1, Leningrad, U.S.S.R.

[21] Appl. No.: 919,510

[22] Filed: Jun. 27, 1978

[51] Int. Cl.[3] ..... B63B 3/00; B63B 5/00; B63B 9/06

[52] U.S. Cl. ..... 114/65 R; 114/77 R; 405/4

[58] Field of Search ..... 405/4, 5, 6, 7; 9/6 R; 114/77 R, 77 A

[56] References Cited

U.S. PATENT DOCUMENTS

| | | | |
|---|---|---|---|
| 3,656,446 | 4/1972 | Heffernan | 405/4 |
| 3,875,887 | 4/1975 | Futtrup | 114/65 R |
| 3,951,088 | 4/1976 | Hikai | 405/6 |
| 3,955,523 | 5/1976 | Kawakhami | 114/77 R |

FOREIGN PATENT DOCUMENTS

| | | | |
|---|---|---|---|
| 51-40359 | of 1976 | Japan . | |
| 1180721 | 2/1970 | United Kingdom | 114/65 R |

*Primary Examiner*—Trygve M. Blix
*Assistant Examiner*—D. W. Keen
*Attorney, Agent, or Firm*—Fleit & Jacobson

[57] ABSTRACT

The invention is concerned with a method for assembling hulls of vessels intended to carry bulk, liquid and gas cargo and comprising an aft end, a parallel middlebody and a fore end. The building berth comprises a main site composed of a rear area and front area and having at least one adjacent transverse lateral area. The parallel middlebody is assembled from two parts. The aft and fore ends are assembled in the lateral area. The two parts which make up the parallel middlebody, and the aft and fore ends then all joined into a hull.

18 Claims, 22 Drawing Figures

METHOD FOR ASSEMBLING HULLS OF VESSELS

FIELD OF THE INVENTION

The present invention relates to shipbuilding and, more particularly, to a method for assembling hulls of vessels intended to carry liquid, bulk and gas cargo.

Such vessels include tankers, bulk carriers, ore carriers, combination ships of all types, such as OO, OB, OBO and PrOBO carriers, as well as LNG and LPG carriers.

The method according to the invention is chiefly applicable and best suited to the assembly of vessels of deadweight tonnages ranging from 20,000 to 500,000 tons.

Hulls of such vessels are assembled on a building berth comprising a main assembly site and at least one lateral area adjacent thereto. There may be a number of lateral areas adjacent to the main site. For building a ship a dry dock with a side chamber or a horizontal building berth complete with a side berth may be used.

BACKGROUND OF THE INVENTION

There is known a method for assembling vessels of the above-mentioned types (cf. Japanese Patent No. 51-40359, Cl. 84K1 of 1976).

According to this method, a hull is assembled in a dry dock composed of a main chamber and a side chamber. The main chamber comprises a rear area, a middle area, and a front area bordering on the harborage area.

In the rear area of the main chamber, sections and modules are assembled with the aid of dock cranes into a parallel middlebody to be transferred to the middle area of the dock's main chamber.

The assembly of the parallel middlebody is accompanied by the assembly of the aft end in the side chamber; upon completion, the aft end, too, is moved to the middle area of the main chamber.

The aft end is then joined to the parallel middlebody. The previously assembled vessel is removed from the front area of the dock's main chamber to the harborage area, and its place is occupied by the new hull with only the fore end missing.

The front area is used to assemble the fore end and join it to the rest of the hull, whereupon the new vessel leaves the dock.

As work is underway in the front area of the main chamber, its middle and rear areas and the side chamber are used for the assembly of other vessels and their sections.

The method under review makes it possible to use a single dock for simultaneous assembly of three vessels of different degrees of completion. Different versions of this method are extensively used at a great number of shipyards.

However, the assembly of superships with the use of this method calls for very long, and thus very expensive, docks.

SUMMARY OF THE INVENTION

It is an object of the present invention to reduce the overall length and cost of building berths.

It is another object of the invention to provide a method for assembling hulls of vessels, which would make it possible to reduce the overall length and cost of building berths by changing the sequence of hull assembly operations.

The foregoing and other objects of the present invention are attained by providing a method for assembling hulls of vessels intended to carry bulk, liquid and gas cargo and comprising an aft end, a parallel middlebody and a fore end, carried out on a building berth comprising a main site, including, in turn, a rear area and a front area, and having at least one lateral area adjacent thereto, whereby, first, the parallel middlebody is assembled, while the aft end is assembled in the lateral area, whereupon the parallel middlebody and the aft end are joined together on the main site, and the fore end is assembled, which method is characterized, according to the invention, in that the parallel middlebody is assembled from two parts, whereof the first part, which is adjacent to the aft end, is assembled first, whereupon there follows the assembly of the second part, adjacent to the fore end, while the latter is assembled in the lateral area to be transferred to the main site where all the assembled parts are joined into a hull.

The method according to the invention makes it possible to reduce the length of a building berth, while maintaining its operating efficiency at a level equal to that of the prototype; according to the method, a reduced building berth length in no way affects the overall building time or the time it takes to assemble the individual sections of a hull, namely, the parallel middlebody and aft and fore ends.

It is expedient that the part of the parallel middlebody adjacent to the aft end should be assembled in the rear area of the main site.

This makes it possible to simultaneously carry out different assembly operations at multiple assembly stations and join the aforesaid hull sections together at assembly areas specifically suited for a given sequence of operations.

The assembled aft end and that part of the parallel middlebody which adjoins the aft end may be joined together on the main site and then transferred to the front area of the main site where the second part of the parallel middlebody, adjacent to the fore end, and the fore end are successively joined to the completed half of the hull.

As a result, the rear area of the main site is left vacant after the transfer of the assembled aft half of the hull to the front area, and can be used for the assembly of the part of the parallel middlebody adjacent to the aft end of another ship. Hence, the main site can be used for simultaneous assembly of middlebodies of different ships.

The part of the parallel middlebody adjacent to the fore end may be assembled in the front area of the main site and then joined to the already completed aft half of the hull, whereupon the fore end is joined to the whole to make a complete hull.

The part of the parallel middlebody adjacent to the fore end may be assembled by successively joining its components to the completed aft half of the hull.

The two parts of the parallel middlebody may be butted to the aft and fore ends, respectively, in the front area of the main site, whereupon the hull is completed by joining its two halves to each other.

This makes it possible to complete a considerable number of fitting-out operations by the time the aft and fore halves are ready to be joined together and thus form a hull.

The two parts of the parallel middlebody may be joined together in the front area of the main site, whereupon the aft and fore ends are butted to the completed parallel middlebody.

This makes it possible to assemble parallel middlebodies and aft and fore ends at specialized assembly areas, whereupon one of such areas is used to join the preassembled units into a hull.

In case the aft and fore halves of a hull are joined together afloat, it is expedient that the part of the parallel middlebody adjacent to the fore end should be assembled in the rear area of the main site to be transferred to the front area of the main site following a removal therefrom of the completed aft half of the hull, whereupon the part of the middlebody adjacent to the fore end is butted to the fore end and moved to the harborage area where the two halves of the hull are joined together.

The assembly of a hull from two halves afloat permits of carrying out a considerable number of fitting-out operations and makes it possible to reduce the length and, consequently, the cost of the building berth.

The assembly of hulls may be carried out on a building berth provided with a second lateral area. The latter is used to assemble the part of the parallel middlebody adjacent to the aft end which upon completion is transferred to the front area of the main site. The fore end is assembled in the first lateral area and is also transferred to the front area of the main site where the two parts of the middlebody and aft and fore ends are all butted together to make a hull.

This also makes it possible to assemble and join together the hull components in specialized assembly areas.

It is expedient in this case that the front area of the main site should be used for joining the aft end to the part of the parallel middlebody adjacent to the aft end, whereupon the same area is used to assemble the part of the parallel middlebody adjacent to the fore end and join it to the completed aft half of the hull, whereupon the fore end is butted to the joined hull components.

It is preferable that the part of the parallel middlebody adjacent to the fore end should be assembled by successively joining its elements to the completed aft half of the hull.

In case the second lateral area is provided the two parts of the parallel middlebody may also be joined to the aft and fore ends, respectively, in the front area of the main site, whereupon the aft and fore halves are joined together to make a hull.

This makes it possible to complete a considerable number of fitting-out operations by the time the two halves of the hull are completed and ready to be joined together.

In this case the front area of the main site may be used to join together the two parts of the parallel middlebody, whereupon the aft and fore ends are butted to the completed parallel middlebody.

This makes it possible to use the method according to the invention in cases when parallel middlebodies and aft and fore ends are assembled in specialized assembly areas to be subsequently joined together in one of such areas.

In case the aft and fore halves of a hull are joined together afloat, it is expedient that the part of the parallel middlebody adjacent to the fore end should be assembled in the lateral area to be transferred to the front area of the main site following a removal therefrom of the completed aft half of the hull, whereupon the part of the middlebody adjacent to the fore end is butted to the fore end and moved to the harborage area where the two halves of the hull are joined together afloat.

The assembly of a hull from two halves afloat, as it is mentioned above, makes it possible to reduce the length and, consequently, the cost of the building berth.

BRIEF DESCRIPTION OF THE ACCOMPANYING DRAWINGS

The invention will now be described in greater detail with reference to preferred embodiments thereof, taken in conjunction with the accompanying drawings, wherein.

DETAILED DESCRIPTION OF THE INVENTION

The method according to the invention for the assembly of hulls of vessels intended to carry bulk, liquid and gas cargo is carried out as follows.

Figure 1:
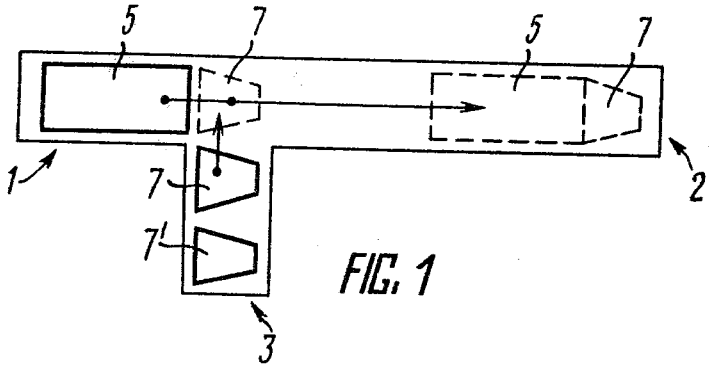
FIG. 1 is a schematic representation of a preferred embodiment of the invention, illustrating the sequence of operations involved in the complete assembly of hulls on a building berth including one lateral assembly area, with the part of the parallel middlebody adjacent to the aft end being assembled in the rear area of the main site.

As pointed out above, the building berth comprises a main site including a rear area 1 (FIG. 1) and a front area 2 adjoining the harborage area. The building berth further includes at least one lateral assembly area 3 adjacent to the main site.

Figure 12:
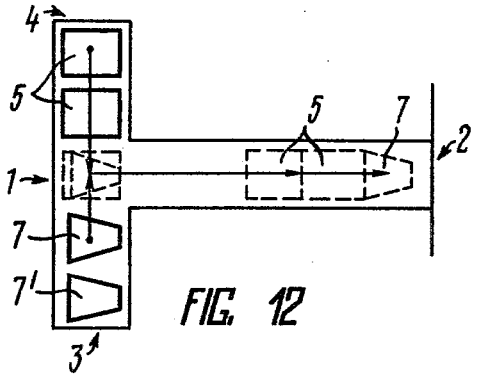
FIG. 12 is a schematic representation of the sequence of operations involved in the assembly of hulls on a building berth having two lateral assembly areas, with the part of the parallel middlebody adjacent to the aft end being assembled in the second lateral area.

The building berth may include a second lateral area 4, a third lateral area, etc., which may be arranged arbitrarily with respect to the main site (FIG. 12).

Figure 2:
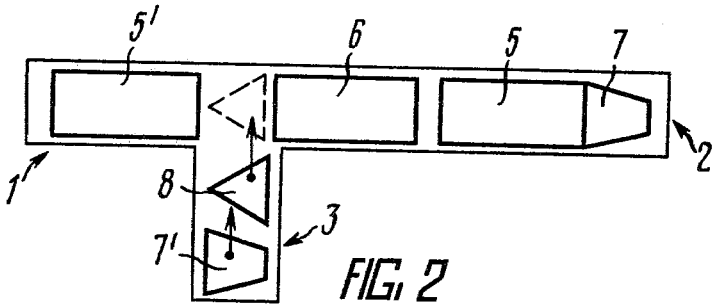
FIG. 2 is a schematic representation of another preferred embodiment of the invention, illustrating the assembly of a hull on a building berth including one lateral area, with the part of the parallel middlebody adjacent to the fore end being assembled in the front area of the main site.

The parallel middlebody of a hull is assembled from two parts 5 and 6. Each of the parts 5 and 6 is assembled using a conventional method, say from modules. The first part 5 of the middlebody is adjacent to an aft end 7. As the part 5 is being assembled, the aft end 7 (FIG. 1) is assembled in the lateral area 3. The aft end 7 is assembled from sections or modules on one, two or more assembly stations. Then, the second part 6 of the parallel middlebody, adjacent to a fore end 8 (FIG. 2), is assembled. The fore end 8 is normally assembled in the lateral area 3. All the four hull components are transferred to the front area 2 of the main site to be joined together and thus make a hull.

When a whole hull is assembled on a building berth with a single lateral assembly area (area 3), the first part 5 of the parallel middlebody is assembled in the rear area 1 of the main site to be then transferred to the front area 2 where the aft end 7 is also transferred upon assembly.

In this case the hull may be assembled in two ways. The aft end 7 may be transferred to the main site to be butted to the part 5 of the parallel middlebody, whereupon the aft half of the hull thus formed is transferred to the front area 2 of the main site.

The aft end 7 and first part 5 of the parallel middlebody may be transferred to the front area 2 without being joined together.

After the part 5 of the parallel middlebody and the aft end 7 are transferred to the front area 2, the latter is used to assemble the second part 6 of the parallel middlebody. The part 6 may be assembled by successively joining its sections and modules to the completed aft half of the hull, composed of the part 5 and aft end 7 joined together. The part 6 may be first fully assembled and then joined to the part 5 of the parallel middlebody and the aft end 7 and fore end 8.

Figure 3:
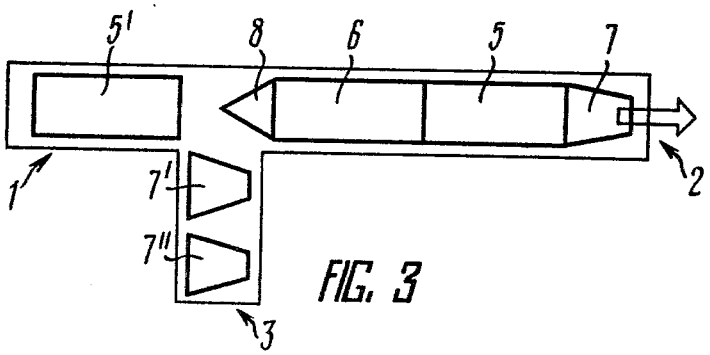
FIG. 3 is a schematic representation of a still another embodiment of the invention, illustrating the assembly of a hull on a building berth with one lateral area and showing a fully assembled hull.

After the fore end 8 is assembled in the lateral area 3 as described above and after the assembly of the part 6 of the parallel middlebody is completed, the fore end 8 is transferred to the front area 2 of the main site, whereupon the parts 5 and 6 of the parallel middlebody are joined together, and the aft and fore ends, 7 and 8, respectively, are joined to them to make a hull (FIG. 3).

The parts 5 and 6 of the parallel middlebody may be first joined to the aft end 7 and fore end 8, respectively, whereupon the two halves of the hull thus formed are joined together.

The parts 5 and 6 of the parallel middlebody may be first joined to each other, whereupon the aft end 7 and fore end 8 are joined to the parts 5 and 6, respectively, to make a hull.

In case the part 5 of the parallel middlebody is joined to the aft end 7 as pointed out above and moved to the front area 2 of the main site, and in case the part 6 of the middlebody is assembled by successively joining its sections to the completed aft half of the hull, the front area 2 is only used for joining the fore end 8 and thus completing the hull.

The order in which the parts 5 and 6 of the parallel middlebody and the aft and fore ends 7 and 8 are joined into a hull on a building berth with a single lateral assembly area is determined by specific assembly conditions.

The finished hull is removed from the building berth, and the foregoing sequence of events is repeated as the next hulls are assembled.

In the drawings the reference numerals of parts of the same vessel are marked with identical indices.

Figure 4:
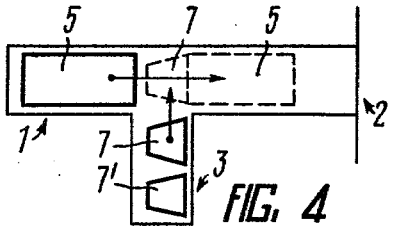
FIG. 4 is a schematic representation of a preferred embodiment of the invention, illustrating the sequence of operations involved in the assembly of a hull from two halves afloat, with the part of the parallel middlebody adjacent to the aft end being assembled in the rear area of the main site.
Figure 5:
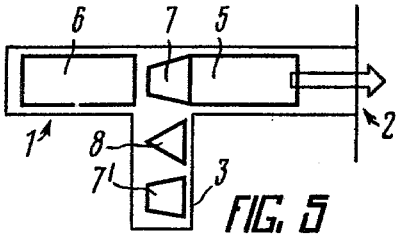
FIG. 5 is a schematic representation of a further preferred embodiment of the invention, illustrating the sequence of operations involved in the assembly of a hull from two halves afloat and showing a completed aft half of the hull.

In case the two halves of a hull are assembled on a building berth with a single lateral area 3 to be joined together afloat, the part 5 of the parallel middlebody is assembled in the rear area 1 (FIG. 4) of the main site and then transferred to the front area 2. The aft end 7 is assembled in the lateral area 3 and transferred to the front area 2 of the main site, whereupon the aft end 7 is joined to the part 5. The aft half of the hull thus assembled is hauled to the harborage area (FIG. 5).

Figure 6:
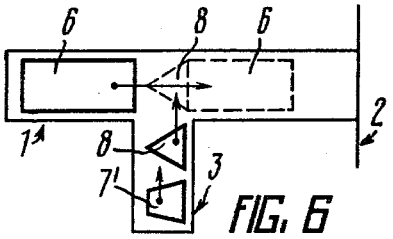
FIG. 6 is a schematic representation of a further preferred embodiment of the invention, illustrating the sequence of operations involved in the assembly of a hull from two halves afloat, with the part of the parallel middlebody adjacent to the fore end being assembled in the rear of the main site.
Figure 7:
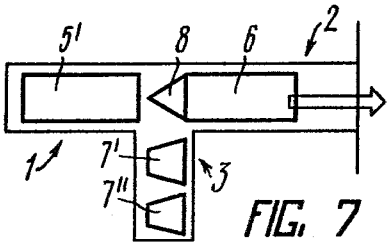
FIG. 7 is a schematic representation of a further preferred embodiment of the invention, illustrating the sequence of operations involved in the assembly of a hull from two halves afloat and showing an assembled fore half of the hull.

The vacated assembly stations of the rear area 1 of the main site and the lateral assembly area 3 are used to assemble the part 6 of the parallel middlebody and the fore end 8 (FIG. 6), respectively. The assembled part 6 of the parallel middlebody may be transferred to the front area 2 of the main site (FIG. 6), whereupon the fore end 8 is also moved to the front area 2 to be joined to the part 6. The fore half of the hull thus made is hauled to the harborage area (FIG. 7).

Upon removal from the building berth, the two halves of the hull are joined together by using one of the known techniques.

The above sequence of events is repeated for the next hulls.

Figure 10:
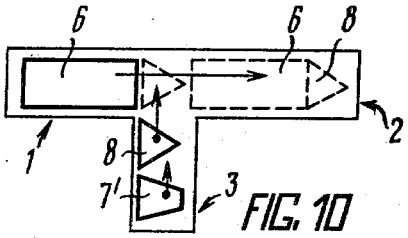
FIG. 10 is a schematic representation of the sequence of operations involved in the assembly of a hull from two halves afloat, with the assembly of the fore end carried out in the lateral assembly area.

The part 6 of the parallel middlebody and the fore end 8 may be joined together in a different way. Upon assembly, the fore end 8 is transferred to the main site, joined to the completed part 6 of the parallel middlebody (FIG. 10) and then moved to the front area 2 of the main site.

Figure 11:
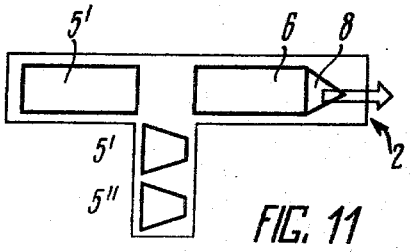
FIG. 11 is a schematic representation of the sequence of operations involved in the assembly of a hull from two halves afloat, when the fore half of the hull is launched to the harborage area fore forward.

The assembled part 6 of the parallel middlebody and the fore end 8 may be independently moved to the front area 2 to be joined together in that area. The fore half of the hull thus completed is moved to the harborage area (FIG. 11), and the above sequence of operations is repeated for the next hulls.

Likewise, the part 5 of the parallel middlebody and the aft end 7 may be joined together in a different manner.

Figure 8:
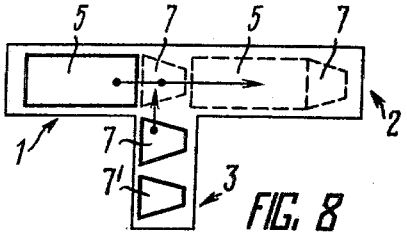
FIG. 8 is a schematic representation of the sequence of operations involved in the assembly of a hull from two halves afloat, with the assembled aft half of the hull being led to the harborage area aft forward.

Upon assembly, the aft end 7 is transferred to the main site to be joined to the preassembled part 5 of the parallel middlebody (FIG. 8), after which the aft half of the hull thus formed is moved to the front area 2 of the main site.

Figure 9:
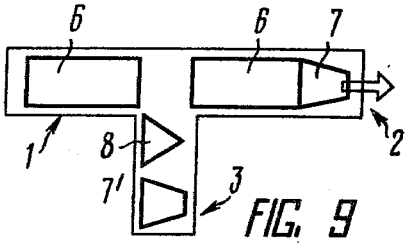
FIG. 9 is a schematic representation of the sequence of operations involved in the assembly of a hull from two halves afloat and showing a fully assembled aft half of the hull.

The part 5 of the parallel middlebody and the aft end 7 may be assembled and indepenently transferred to the front area 2 to be joined together in that area. The aft half of the hull thus completed is moved to the harborage area (FIG. 9).

In this case the part 6 of the parallel middlebody and the fore end 8 are joined as described above (FIGS. 6 and 7 or 10 and 11).

Figure 13:
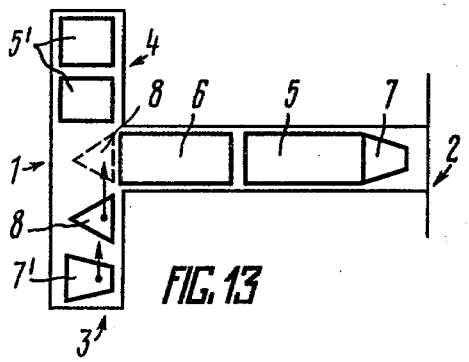
FIG. 13 is a schematic representation of the sequence of operations involved in the assembly of a hull, with the part of the parallel middlebody adjacent to the fore end being assembled in the front area of the main site.

If a hull is assembled on a building berth provided with two lateral areas 3 and 4, the part 5 of the parallel middlebody is assembled in one of the lateral areas, for example, in the area 4 (FIG. 12), whereupon it is moved to the front area 2 of the main site. Simultaneously, the aft end 7 is assembled in the lateral area 3 and also moved to the front area 2 of the main site. The front area 2 is also used to assemble the part 6 of the parallel middlebody (FIG. 13). The part 6 may be assembled by successively joining its sections and modules to the completed aft half of the hull composed of the part 5 of the parallel middlebody and the aft end 7 joined together. The part 6 may be assembled independently and then joined to the part 5 of the parallel middlebody, which is followed by joining the aft and fore ends 7 and 8 to the completed parallel middlebody.

Figure 14:
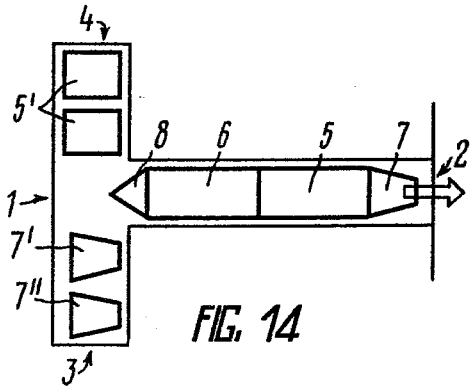
FIG. 14 is a schematic representation of a further preferred embodiment of the invention, showing a fully assembled hull on a building berth with two lateral assembly areas.

After completing the assembly of the fore end 8 in one of the lateral areas, for example, in the area 3, and after assembling the part 6 of the parallel middlebody, the fore end 8 is moved to the front area 2 of the main site, whereupon the parts 5 and 6 of the parallel middlebody are butted to each other, and the aft and fore ends 7 and 8 are joined to the parallel middlebody thus completed to make a hull (FIG. 14).

The joining of the parts 5 and 6 of the parallel middlebody and of the aft and fore ends 7 and 8 is done as described above (FIG. 3).

The finished hull is removed from the building berth, and the above sequence of events is repeated for the next hulls.

Figure 15:
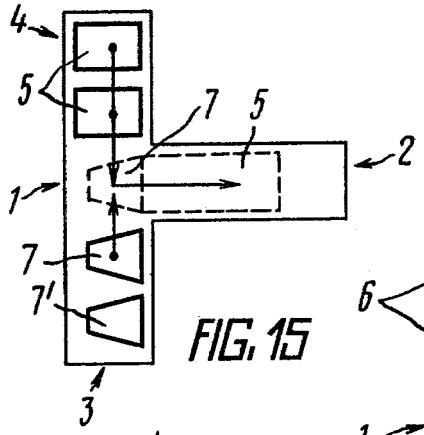
FIG. 15 is a schematic representation of the sequence of operations involved in the assembly of a hull from two halves afloat, with the assembled aft end and the part of the parallel middlebody adjacent to the aft end being joined together on the main site.
Figure 16:
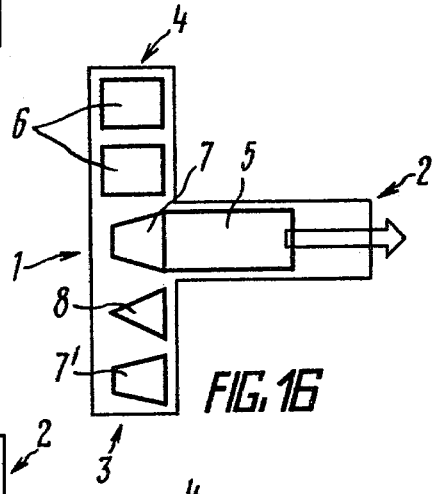
FIG. 16 is a schematic representation of the sequence of operations involved in the assembly of a hull, when the aft half of the hull is led to the harborage area the parallel middlebody part forward.
Figure 17:
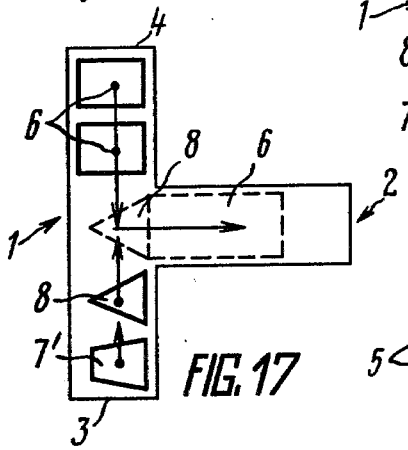
FIG. 17 is a schematic representation of the sequence of operations involved in the assembly of a hull, with the fully assembled fore end and part of the parallel middlebody adjacent to the fore end being joined together on the main site.

If hull components are assembled on a building berth with two lateral assembly areas 3 and 4, and if the hull itself is assembled afloat, the part 5 of the parallel middlebody is assembled in one of the lateral areas, for example, in the area 4 (FIG. 15) and moved to the front area 2 of the main site. The aft end 7 is assembled in this case in the other lateral area 3 and also moved to the front area 2 of the main site. In the front area 2 (FIG. 16), the part 5 and aft end 7 are butted to each other, and the aft half of the hull thus completed is hauled to the harborage area. The vacated assembly stations of the lateral areas 4 and 3 are used to assemble the part 6 of the parallel middlebody and the fore end 8, respectively (FIG. 17).

Figure 18:
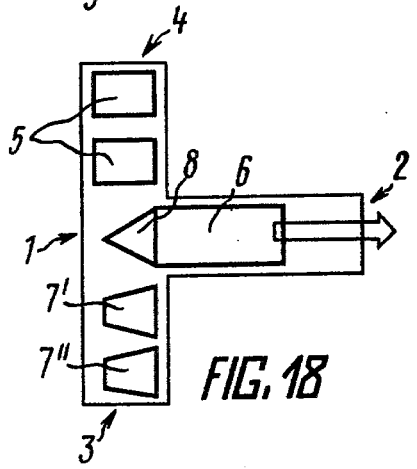
FIG. 18 is a schematic representation of the sequence of operations involved in the assembly of a hull, with the fore half of the hull being led to the harborage area the parallel middlebody part forward.

Upon assembly, the part 6 of the parallel middlebody and then the fore end 8 are moved to the front area 2 of the main site where they are joined together, and the fore half of the hull thus formed is removed to the harborage area (FIG. 18).

The two halves of the hull are joined afloat by using any known technique.

The above sequence of events is repeated for the next hulls.

Figure 21:
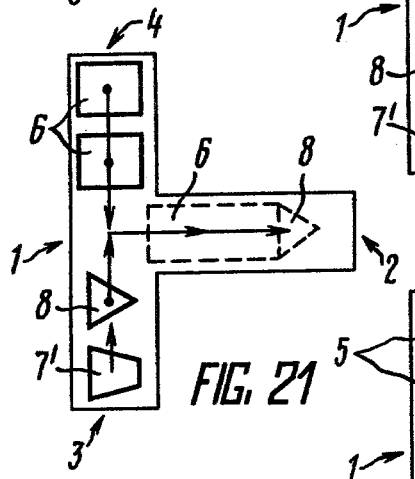
FIG. 21 is a schematic representation of the sequence of operations for the case when the part of the parallel middlebody adjacent to the fore end is assembled in one lateral area, whereas the fore end is assembled in the opposite lateral area.
Figure 22:
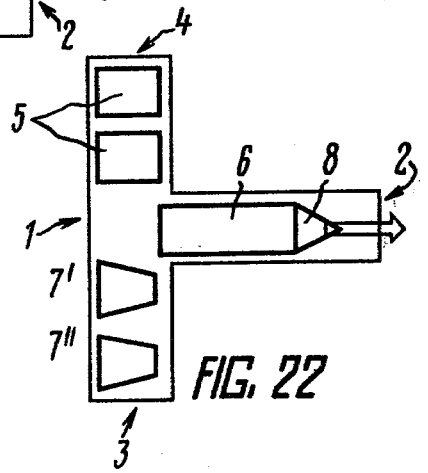
FIG. 22 is a schematic representation of the sequence of operations for the case when the fore half of the hull is led to the harborage area fore forward.

The part 6 of the parallel middlebody and the fore end 8 may be joined together in a different manner. Upon the assembly, the fore end 8 is transferred to the front area 2 of the main site (FIG. 21), after which the preassembled part 6 of the parallel middlebody is also transferred to that area. The fore end 8 and part 6 are joined together and hauled to the harborage area (FIG. 22).

The foregoing sequence of events is repeated while the next hulls are assembled.

The part 5 of the parallel middlebody may be joined to the aft end 7 as follows.

Figure 19:
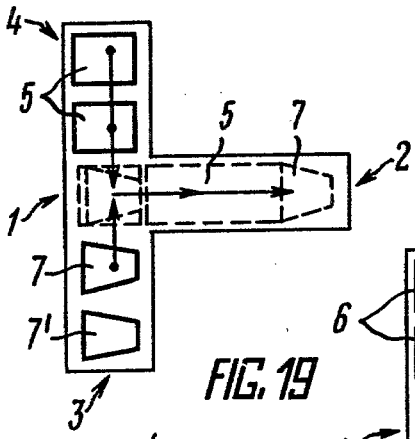
FIG. 19 is a schematic representation of the sequence of operations involved in the assembly of a hull, with the part of the parallel middlebody adjacent to the aft end and the aft end being assembled in the opposite lateral areas.
Figure 20:
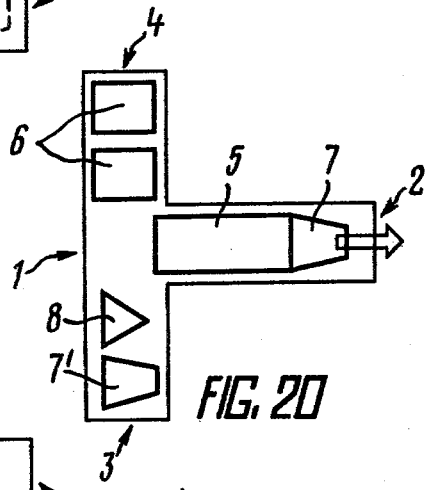
FIG. 20 is a schematic representation of the sequence of operations for the case when the aft half of the hull is led to the harborage area aft forward.

Upon assembly, the aft end 7 is transferred to the front area 2 of the main site (FIG. 19), whereupon the already assembled part 5 of the parallel middlebody is also brought to that area. The part 5 and aft end 7 are joined together, and the aft half of the hull thus completed is moved to the harborage area (FIG. 20).

In this case the part 6 of the parallel middlebody and the fore end 8 are joined as described above (FIGS. 17 and 18 or 21 and 22).

The method for assembling hulls of vessels according to the invention makes it possible to substantially reduce the effective length of a building berth without affecting its operating efficiency. In cases when hulls are fully assembled on a building berth, the use of the method according to the invention makes it possible to reduce the length of the building berth by about 30 percent and when the final assembly of hulls is carried out afloat, the method makes it possible to reduce the effective length of a building berth almost by half as compared with the employment of conventional hull assembly techniques, such as the semitandem method. The hull assembly costs are thus significantly reduced due to curtailed investments in the building of dry docks and cheaper maintenance of the docks.

The method according to the invention makes it possible to use specialized assembly areas to assemble such complicated hull components as the parallel middlebody and fore and aft sections.

The use of the main assembly site and the lateral area specifically for assembling parallel middlebodies and fore and aft ends, respectively, enables one to employ different methods of assembly. For example, parallel middlebodies can be assembled from modules without using conventional cranes, whereas streamlined fore and aft ends are assembled from sections delivered by cranes to assembly areas specifically intended for the purpose.

Assembling parallel middlebodies from modules without using cranes makes it possible to cover building berths with relatively cheap sheds of a relatively small height calculated as the sum total of the hull moulded depth and the necessary safety spacing between the hull upper deck and the sheds.

What is claimed is:

1. A method for assembling hulls of vessels intended to carry bulk, liquid and gas cargo and comprising an aft end, a parallel middlebody and a fore end, the method being carried out on a building berth comprising a main site composed of a rear area and a front area and including at least one adjacent transverse lateral area, said method comprising:

assembling a first part of said parallel middlebody, adjacent to said aft end, in the rear area of said main site;

assembling said aft end in said lateral area;

transferring said assembled aft end to the front area of said main site;

transferring said assembled part of the parallel middlebody adjacent to said aft end to the front area of said main site;

assembling a second part of said parallel middlebody, adjacent to said fore end, in the front area of said main site;

assembling said fore end in said lateral area;

transferring said assembled fore end to the front area of said main site;

joining together said assembled aft end, said assembled part of the parallel middlebody adjacent to the aft end, said assembled part of the parallel middlebody adjacent to the fore end, and said assembled fore end to form a completed hull; and launching the completed hull.

2. A method according to claim 1, wherein said adjacent transverse lateral area is positioned adjacent the leading end of the rear area and adjacent the trailing end of the front area, the length of the rear area being approximately one half the length of an assembled hull.

3. A method as claimed in claim 1, whereby said assembled part of the parallel middlebody adjacent to said aft end and said aft end are joined together on the main site, whereupon both are transferred to the front area of said main site.

4. A method as claimed in claim 1, whereby said second part of the parallel middlebody adjacent to said fore end is assembled by successively joining its components to the assembled first part of the parallel middlebody butted to said aft end.

5. A method as claimed in claim 1, whereby said second part of the parallel middlebody adjacent to said fore end is joined to the first part of the parallel middlebody butted to the aft end, which joining is done in the front area of said main site.

6. A method as claimed in claim 1, whereby said second part of the parallel middlebody adjacent to said fore end is joined to said fore end in the front area of said main site.

7. A method for assembling hulls of vessels intended to carry bulk, liquid and gas cargo and comprising an aft end, a parallel middlebody and a fore end, the method being carried out on a building berth comprising a main site composed of a rear area and a front area and including at least one adjacent transverse lateral area, said method comprising:

assembling a first part of said parallel middlebody, adjacent to said aft end, in the rear area of said main site;

assembling said aft end in said lateral area;

transferring said assembled aft end to the front area of said main site;

transferring said assembled part of the parallel middleboby adjacent to the aft end to the front area of said main site;

joining together said aft end and said part of the parallel middlebody adjacent to said aft end to form an aft half of the hull;

launching the completed aft half of the hull;

assembling a second part of said parallel middlebody, adjacent to said fore end, in the front area of said main site;

assembling said fore end in said lateral area;

transferring said assembled part of the parallel middlebody adjacent to said fore end to a joining station of said main site;

transferring said assembled fore end to the joining station of said main site;

joining together said fore end and said part of the parallel middlebody adjacent to said fore end to form a fore half of the hull;

launching the fore half of the hull;

joining together afloat the two parts of the parallel middlebody, butted to the aft end and fore end, respectively.

8. A method according to claim 7, wherein said adjacent transverse lateral area is positioned adjacent the leading end of the rear area and adjacent the trailing end of the front area, the lengths of the rear and front areas being approximately one half the length of an assembled hull.

9. A method for assembling hulls of vessels intended to carry bulk, liquid and gas cargo and comprising an aft end, a parallel middlebody and a fore end, the method being carried out on a building berth comprising a main site composed of a rear area and a front area and including two adjacent transverse lateral areas, said method comprising:

assembling a first part of said parallel middlebody, adjacent to said aft end, in one of said lateral areas;

assembling said aft end in the other of said lateral areas;

transferring said assembled part of the parallel middlebody adjacent to the aft end to the front area of said main site;

transferring said assembled aft end to the front area of said main site;

assembling a second part of said parallel middlebody, adjacent to said fore end, in the front area of said main site;

assembling said fore end in any one of said lateral areas;

transferring said assembled fore end to a joining station of said main site;

joining together said assembled part of the parallel middlebody adjacent to the aft end, said assembled aft end, said assembled part of the parallel middlebody adjacent to the fore end, and said assembled fore end to form a completed hull; and launching the completed hull.

10. A method according to claim 9, wherein the transverse lateral areas are positioned on opposite sides of the rear area.

11. A method according to claim 9 or 10, wherein the transverse lateral areas are positioned at the same elevation.

12. A method as claimed in claim 9, whereby said second part of the parallel middlebody adjacent to said fore end is assembled by successively joining its components to the first part of the parallel middlebody butted to said aft end.

13. A method as claimed in claim 9, whereby said second part of the parallel middlebody adjacent to said fore end is joined to the first part of the parallel middlebody butted to said aft end, which joining is done in the front area of said main site.

14. A method as claimed in claim 9, whereby said second part of the parallel middlebody adjacent to said fore end is butted to said fore end in the front area of said main site.

15. A method for assembling hulls of vessels intended to carry bulk, liquid and gas cargo and comprising an aft end, a parallel middlebody and a fore end, the method being carried out on a building berth comprising a main site composed of a rear area and a front area and including two adjacent transverse lateral areas, said method comprising:

assembling a first part of said parallel middlebody, adjacent to the aft end, in one of said transverse lateral areas;

assembling said aft end in the other of said transverse lateral areas;

transferring said assembled part of the parallel middlebody adjacent to the aft end to the front area of said main site;

transferring said assembled aft end to the front area of said main site;

joining together said aft end and said part of the parallel middlebody adjacent to said aft end to form an aft half of the hull;

launching the aft half of the hull;

assembling a second part of said parallel middlebody, adjacent to said fore end, in one of said lateral areas;

assembling said fore end in the other of said lateral areas;

transferring said assembled part of the parallel middlebody adjacent to said fore end to the front area of said main site;

transferring said assembled fore end to the front area of said main site;

joining together said fore end and said part of the parallel middlebody, adjacent to said fore end to form a fore half of the hull;

launching the fore half of the hull; and joining together afloat said two parts of the parallel middlebody, butted to said aft end and fore end, respectively.

16. A method according to claim 15, wherein the transverse lateral areas are positioned on opposite sides of the rear area.

17. A method according to claim 15 or 16, wherein the transverse lateral areas are positioned at the same elevation.

18. A method according to claim 15, wherein the combined lengths of the rear and front areas is less than the length of an assembled hull.

* * * * *